United States Patent [19]

Carnera

[11] Patent Number: 4,592,472

[45] Date of Patent: Jun. 3, 1986

[54] PORTABLE, LIGHTWEIGHT CLOTHESLINE ASSEMBLY

[76] Inventor: Umberto E. Carnera, P.O. Box 1616, Dunedin, Fla. 33528

[21] Appl. No.: 675,873

[22] Filed: Nov. 28, 1984

[51] Int. Cl.[4] ..... D06F 53/00

[52] U.S. Cl. ..... 211/119.01; 211/208

[58] Field of Search ..... 211/119.01, 119.12, 211/119.10, 119.13, 119.14, 208, 119.16, 119.17, 87; 248/225.2, 220.3, 303, 317

[56] References Cited

U.S. PATENT DOCUMENTS

| | | | |
|---|---|---|---|
| 693,401 | 2/1902 | Johnson | 211/119.13 |
| 2,360,458 | 10/1944 | Wentz | 211/119.1 |
| 3,193,235 | 7/1965 | Jensen | 248/317 |
| 3,278,149 | 10/1966 | Brucker | 211/208 X |
| 4,103,778 | 8/1978 | Bradshaw | 211/208 X |
| 4,139,174 | 2/1979 | Olson | 248/317 |
| 4,146,141 | 3/1979 | Winter et al. | 211/208 |
| 4,311,243 | 1/1982 | Hui-Lai | 211/113 |
| 4,319,531 | 3/1982 | Caldwell | 248/220.3 X |

FOREIGN PATENT DOCUMENTS

| | | | |
|---|---|---|---|
| 2373711 | 8/1978 | France | 248/220.3 |

*Primary Examiner*—Robert W. Gibson, Jr.
*Assistant Examiner*—Blair M. Johnson
*Attorney, Agent, or Firm*—Stanley M. Miller

[57] ABSTRACT

A clothesline assembly including an elongate chain, a pair of mounting strip members, and a pair of bracket members. The mounting strip members are preferably permanently secured to upstanding support structures such as walls. The amount of space between the mounting strip members substantially determines the length of chain that can be operably deployed therebetween. The mounting strip members are adapted to releasably receive the proximal ends of the respective bracket members. The respective distal ends of the bracket members are adapted to releasably engage links at opposite ends of the chain. Accordingly, the specific positions chosen for the placement of the bracket members on the mounting strip members substantially determines the height of the chain extending therebetween. Clothes to be dried are placed on conventional clothes hangers and the hangers are suspended from different links of the chain.

2 Claims, 6 Drawing Figures

PORTABLE, LIGHTWEIGHT CLOTHESLINE ASSEMBLY

BACKGROUND OF THE INVENTION

1. Field of the Invention

This invention relates, generally, to clothesline assemblies. More particularly, it relates to an assembly that includes a horizontally disposed chain supported at its opposite ends by bracket members which in turn are supported by mounting strip members that are secured to upstanding walls the amount of spacing between which establishes the length of the clothesline defined by the chain.

2. Description of the Prior Art

The rules of many apartment complexes and condominium developments prohibit the erection of permanent clothesline structures because the same are considered unsightly. Those making their homes in such facilities are thus either burdened with the cost of running power-hungry dryers or with the trouble of putting up and taking down temporary clotheslines on wash days.

The most common form of temporary clothesline is a rope the opposite ends of which are attached by miscellaneous means to opposed, spaced walls of the type that typically define a balcony area. The ends of the rope are typically secured with a knot to brackets which in turn are fastened to the walls by screws. Another method involves the use of nails which are driven into walls and then bent to form a hook for the line. This method also requires the tying of knots to secure the opposite ends of the line to the respective nails. Regardless of which installation technique is employed, the rope must be taken down after use as no permanent attachment means are allowed.

The problems with these temporary clotheslines of the prior art are many. Screws or nails mar walls and nails projecting outwardly from walls in particular are hazardous to passersby since clotheslines are typically hung at eye level. Moreover, the clothes hangers which are hung from the rope tend to slidingly congregate together toward the center of the rope as it sags under their collective weight. Air cannot adequately circulate between the clothes supported by such closely spaced hangers. Further, poorly tied knots result in the unwanted depositing of wet clothes on the ground. The "home made" clotheslines of the prior art have further drawbacks as well, this brief discussion serving merely to point out the most obvious shortcomings.

Clearly, there is a need for a clothesline assembly that is easy to erect and disassemble and that maintains clothes hangers hung thereon in spaced apart relation to one another, but the needed assembly does not appear in the prior art.

SUMMARY OF THE INVENTION

The longstanding but heretofore unfulfilled need for a clothesline assembly which overcomes the limitations of the prior art is now fulfilled by an assembly that includes a chain, a pair of mounting brackets, and a pair of mounting strips.

The mounting strips are fixedly secured by suitable means such as screw members to opposed walls. Walls perpendicular to one another may also be employed. Each strip is preferably in the form of an angle iron member and has a plurality of equidistantly spaced apertures along both of its side walls. A first side wall of the angle iron may thus be fixedly secured to a support surface such as the exterior wall of a building so that the second side wall, being integrally formed with and disposed normal to the first side wall, projects perpendicularly from such exterior wall and hence provides a mounting surface to which the brackets may be releasably secured.

More specifically, each bracket member has a proximal and a distal end. The proximal end of each bracket is adapted to be releasably engaged by a preselected aperture formed in the outwardly projecting side wall of the angle iron member. The distal end of each bracket is adapted to releasably engage a chain link. In this manner, the height of the clothesline to be erected is determined when the brackets are connected to the respective mounting strips, care being taken, of course, to align the brackets in a common horizontal plane so that the chain will be level when it is suspended between the brackets.

It is therefore understood that an important object of this invention is to provide a light weight, portable clothesline assembly that is easy to assemble and disassemble.

Another important object is to provide a clothesline that includes means for maintaining the spacing between contiguous clothes hanger means detachably secured thereto along the length thereof.

The invention accordingly comprises the features of construction, combination of elements and arrangement of parts that will be exemplified in the construction hereinafter set forth, and the scope of the ivention will be indicated in the claims.

BRIEF DESCRIPTION OF THE DRAWINGS

For a fuller understanding of the nature and objects of the invention, reference should be made to the following detailed description, taken in connection with the accompanying drawings, in which.

Similar reference numerals refer to similar parts throughout the several views of the drawings.

DESCRIPTION OF THE PREFERRED EMBODIMENT

Figure 1:
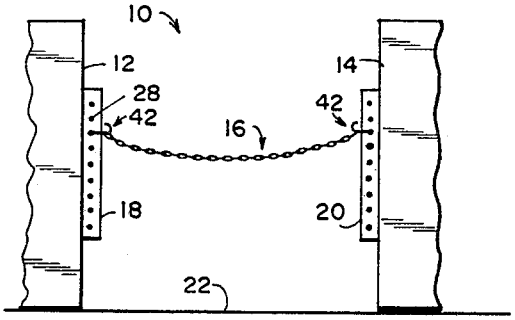
FIG. 1 is a side elevational, diagrammatic representation of a clothesline installation that embodies the teachings of this invention.

Refering now to FIG. 1, it will there be seen that the environment of the novel assembly is indicated by the reference numeral 10 as a whole. Upstanding walls 12 and 14 are shown disposed in opposed relation to one another, but it should be understood from the outset that the inventive assembly to be described herein may also be deployed in an environment that includes walls forming an angle with one another, i.e., perpendicular walls meeting at an internal corner, and in other environments as well.

Chain 16 is depicted in its installed, i.e., operable disposition in FIG. 1. The mounting strip members 18, 20 are shown in exaggerated size to simplify the drawing, and reference numeral 22 indicates the ground or other horizontal support surface upon which the user of the inventive clothesline assembly stands when deploying, using or disassembling the same.

Figure 2:
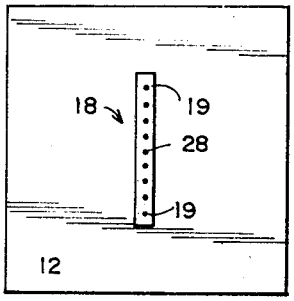
FIG. 2 is a front elevational view of one of the mounting strips, specifically, the mounting strip shown more fully in FIG. 3.
Figure 3:
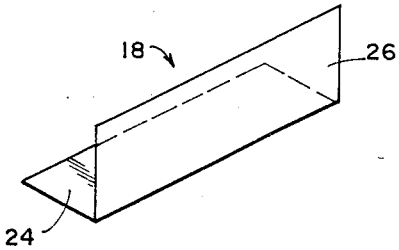
FIG. 3 is an isometric view of one type of mounting strip that can be employed in the inventive assembly, the apertures formed therein not being shown to simplify the drawing.

FIG. 2 shows that mounting strip member 18 or 20 is vertically aligned when attached to wall 12 or 14, respectively. The strip is shown enlarged with respect to the boundaries of the wall to better bring out the construction of the strip. As shown in FIG. 3, the preferred form of the strip is that of an angle iron, although the term "iron" need not be construed to identify the material that forms the strip since it is preferably formed of aluminum or other suitable material. As best seen in FIG. 3, the mounting strip members 18 or 20 are defined by integrally formed, orthogonally disposed side walls 24 and 26, and such side walls have formed therein a plurality of equidistantly spaced aperture means collectively designated 28 as shown in FIGS. 1 and 2.

Figure 4:
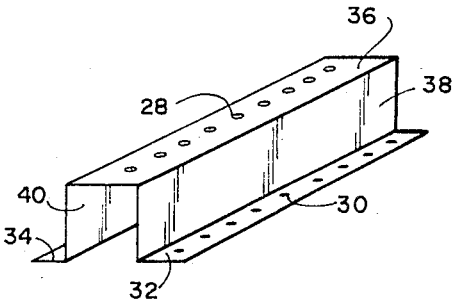
FIG. 4 is a perspective view of a second type of mounting strip that can be employed in the inventive assembly.

Another form that the mounting strips 18 or 20 may take is shown in FIG. 4. Apertures 30 are formed in flange members 32, 34, and the equivalent of apertures 28 are formed in the top wall 36 that is spaced from wall 12 or 14 by upstanding side walls 38, 40.

The mounting strip of FIGS. 1, 2 and 3 is secured to a wall by suitable fastening means such as screw members 19 shown in FIG. 2. The mounting strip of FIG. 4 is secured to a wall by screw members, not shown, which extend through the apertures 30 formed in the flange members 32, 34.

Figure 5:
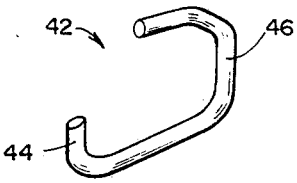
FIG. 5 is a perspective view of a bracket member that can be employed in the inventive assembly.

The bracket member 42 shown in FIG. 5 may be used with the mounting strip of FIG. 3 or the mounting strip of FIG. 4, as desired. The mounting strips may take forms other than those illustrated, in that the only physical requirement of the mounting strips used with this invention is the provision of a flat, elongate wall having apertures 28 formed therein in spaced relation to an upstanding support wall such as walls 12, 14.

Bracket member 42 has an upturned distal end 44 and a proximal end 46 having a return bend formed therein, as shown in FIG. 5. Distal end 44 is specifically configured and dimensioned to be slideably engageable with apertures 28 so that such bracket can be quickly and easily attached and detached from its associated mounting strip 18 or 20. When distal end 44 of a bracket 42 is engaged with one of the apertures 28, proximal end 46 of such bracket will project in cantilevered fashion from the mounting strip as depicted in FIG. 1 if distal end 44 lies in a plane rotated ninety (90) degrees relative to the plane of the proximal end 46 thereof. If distal end 44 and proximal end 46 are coplanar as depicted in FIG. 5, the proximal end 46 will lie in a horizontal plane but will still be operative to engage a preselected link of chain 16.

The bracket of FIG. 5 will project in cantilevered fashion as depicted in FIG. 1 if the mounting strip of FIG. 4 is employed in lieu of the mounting strip shown in FIGS. 1, 2 and 3.

Irrespective of the type of mounting strip or bracket used, chain 16 may be suspended in the manner shown in FIG. 1 to erect the clothesline. Clearly, since there are no knots to untie, the chain 16 may be taken down simply by disengaging it fom the return bend formed in the distal end 46 of the respective brackets. The brackets themselves can be removed from mounting apertures 28 if desired, or left in place. Moreover, one end of the chain 16 can remain engaged with a bracket at all times, and the other end of the chain may be brought over to the chain-engaging bracket and attached thereto. In this manner, one bracket can hold the chain in a stored configuration until deployment of the chain is again desired.

Figure 6:
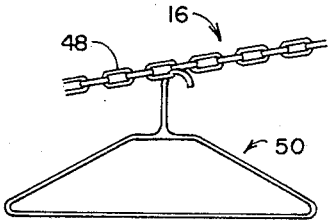
FIG. 6 is a perspective view of a portion of a chain of the type that can be used in the inventive assembly.

FIG. 6 depicts the manner in which the links 48 of the chain 16 are employed. Clearly, a clothes hanger 50 will be unable to slide from one link to another and as a result clothes-bearing hangers hung from separate links cannot congregate into abutting groups and air can circulate as desired between such hangers.

The chain 16 is preferably formed of plastic to make it light weight and substantially inert with respect to the elements. The plastic selected should of course have good tensile strength and should be capable of supporting a full load of wet clothes-bearing hangers. Circular in configuration links are preferred but of course are not required.

The inventive assembly can replace any permanent clothesline installation, and, as has been seen, is usable with conventional clothes hangers. The chain, the mounting strips and the bracket members of the inventive assembly are commercially available so the invention can be economically manufactured and easily afforded by residents of apartments, condominiums, dormitories, and the like.

With the addition of an "S"-shaped pair of bracket members, not shown, the opposite ends of the chain could be wrapped around tree trunks or other post-like objects and such "S"-shaped brackets could thereby engage a link of the chain to form closed loops at each end thereof. This would eliminate any requirement for a mounting strip of the type shown in the first four (4) figures.

Moreover, it should be understood that the inventive structure has utility not only in connection with clothes hangers of the type shown in FIG. 6, but in connection with the use of standard, spring-loaded clothespins as well. Clothespins may be attached to the chain member 16 in substantially the same manner as the same would be attached to a conventional rope-like clothesline. Accordingly, clothes to be dried could then be held by such clothespins in the well-known manner.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A portable clothesline assembly, comprising:

a pair of spaced apart, upstanding support surface elements;

a pair of mounting strip elements, each member of said pair of mounting strip elements being fixedly secured to an associated support surface element;

each member of said pair of mounting strip elements having the form of an angle iron, both of the walls of which have formed therein a plurality of spaced apertures;

an elongate, flexible chain;

said chain formed by a plurality of interconnected link members;

first and second bracket members;

each of said bracket members having first and second opposed ends;

the respective first ends of said bracket members being formed so as to be releasably secureable to the opposite ends of said chain;

the respective second ends of said bracket members being formed so as to be releasably engageable with preselected apertures formed in an associated mounting strip element;

and each of said link members providing a support means from which a clothes hanger may be suspended.

2. The assembly of claim 1, wherein the respective second ends of said bracket members have return bends formed therein.

* * * * *